US010862215B2

(12) United States Patent
Liu et al.

(10) Patent No.: US 10,862,215 B2
(45) Date of Patent: Dec. 8, 2020

(54) ANTENNA DEVICE AND BEAM DIRECTION ADJUSTMENT METHOD APPLIED TO ANTENNA DEVICE

(71) Applicant: Huawei Technologies Co., Ltd., Shenzhen (CN)

(72) Inventors: Qing Liu, Shenzhen (CN); Shuhui Sun, Shenzhen (CN); Aimeng Wang, Wuhan (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 165 days.

(21) Appl. No.: 16/312,862

(22) PCT Filed: Jul. 5, 2016

(86) PCT No.: PCT/CN2016/088550
§ 371 (c)(1),
(2) Date: Dec. 21, 2018

(87) PCT Pub. No.: WO2018/006260
PCT Pub. Date: Jan. 11, 2018

(65) Prior Publication Data

US 2019/0221941 A1 Jul. 18, 2019

(51) Int. Cl.
*H01Q 9/30* (2006.01)
*H01Q 1/38* (2006.01)
(Continued)

(52) U.S. Cl.
CPC ..... *H01Q 9/30* (2013.01); *H01Q 1/32* (2013.01); *H01Q 1/3233* (2013.01); *H01Q 1/38* (2013.01); *H01Q 1/48* (2013.01); *H01Q 19/26* (2013.01)

(58) Field of Classification Search
CPC ..... H01Q 9/30; H01Q 1/48; H01Q 19/26; H01Q 1/3233; H01Q 1/38; H01Q 1/32
(Continued)

(56) References Cited

U.S. PATENT DOCUMENTS

2004/0263394 A1* 12/2004 Harano ..... H01Q 19/005 343/700 MS
2007/0273600 A1* 11/2007 Tsujimura ..... H01Q 19/13 343/787

(Continued)

FOREIGN PATENT DOCUMENTS

CN 201656965 U 11/2010
CN 102176533 A 9/2011

(Continued)

*Primary Examiner* — Hai V Tran
(74) *Attorney, Agent, or Firm* — Slater Matsil, LLP

(57) ABSTRACT

An antenna device and a beam direction adjustment method are provided. The antenna device includes an antenna element, a metal element, and a substrate. The antenna element and the metal element are separately disposed on the substrate at a preset distance. A ground point of the metal element is fastened on a pad of the substrate, and the ground point is on a side of the metal element close to the antenna element. A first reverse current opposite to an antenna current generated by the antenna element is obtained through coupling on the side of the metal element close to the antenna element, and a second reverse current opposite to a substrate current generated by the substrate is obtained through coupling at a lower part of the metal element that is in contact with the substrate.

20 Claims, 16 Drawing Sheets

(51) Int. Cl.
*H01Q 1/32* (2006.01)
*H01Q 1/48* (2006.01)
*H01Q 19/26* (2006.01)

(58) Field of Classification Search
USPC ..... 343/711
See application file for complete search history.

(56) References Cited

U.S. PATENT DOCUMENTS

2009/0140929 A1* 6/2009 Inoue ..... H01Q 9/42
343/700 MS
2012/0176292 A1* 7/2012 Hung ..... H01Q 1/243
343/846
2014/0131455 A1* 5/2014 Takigahira ..... H01Q 1/2208
235/492

FOREIGN PATENT DOCUMENTS

CN 202977650 U 6/2013
CN 103688409 A 3/2014
EP 1594187 A1 11/2005

* cited by examiner

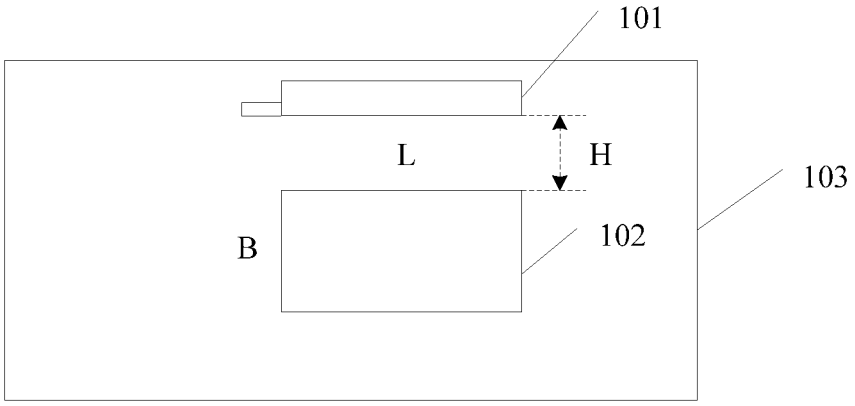
FIG. 1
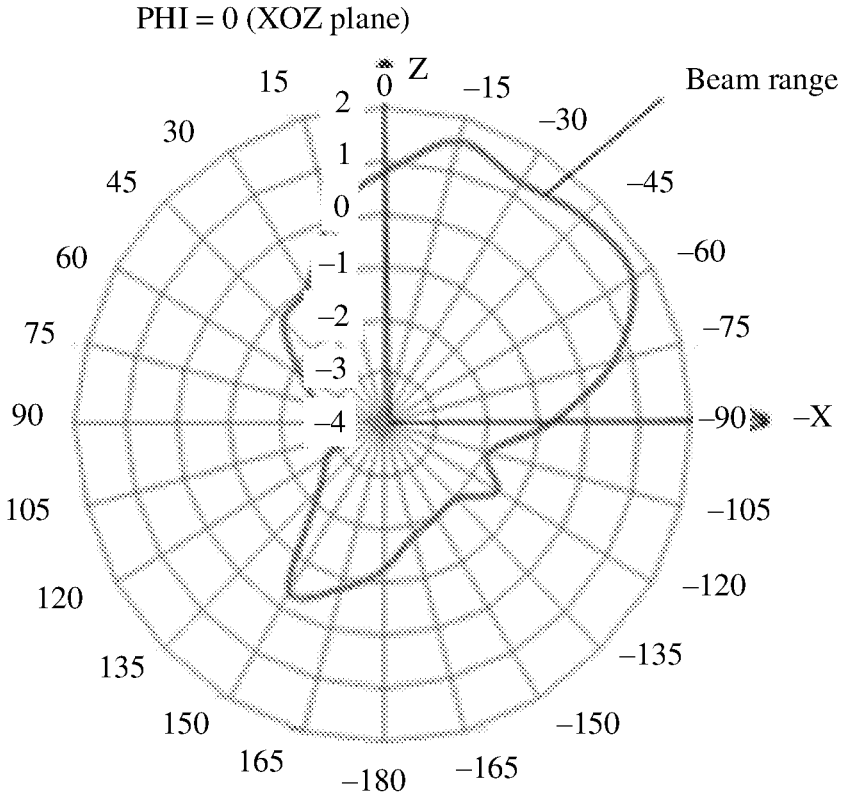
FIG. 2-a

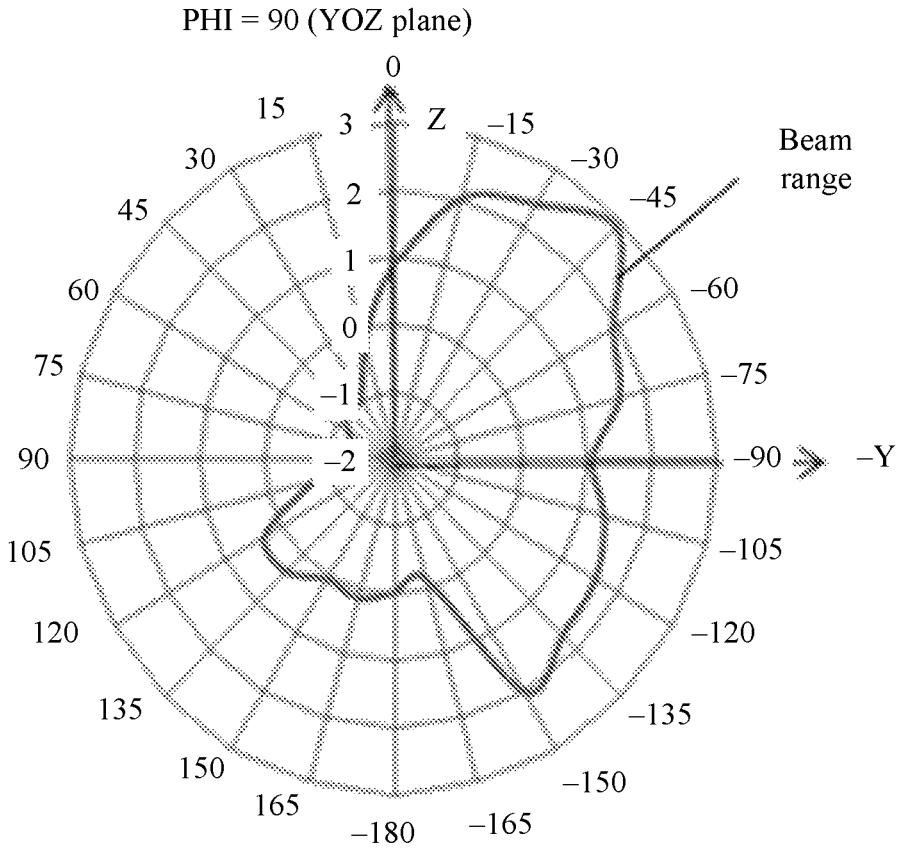
FIG. 2-b

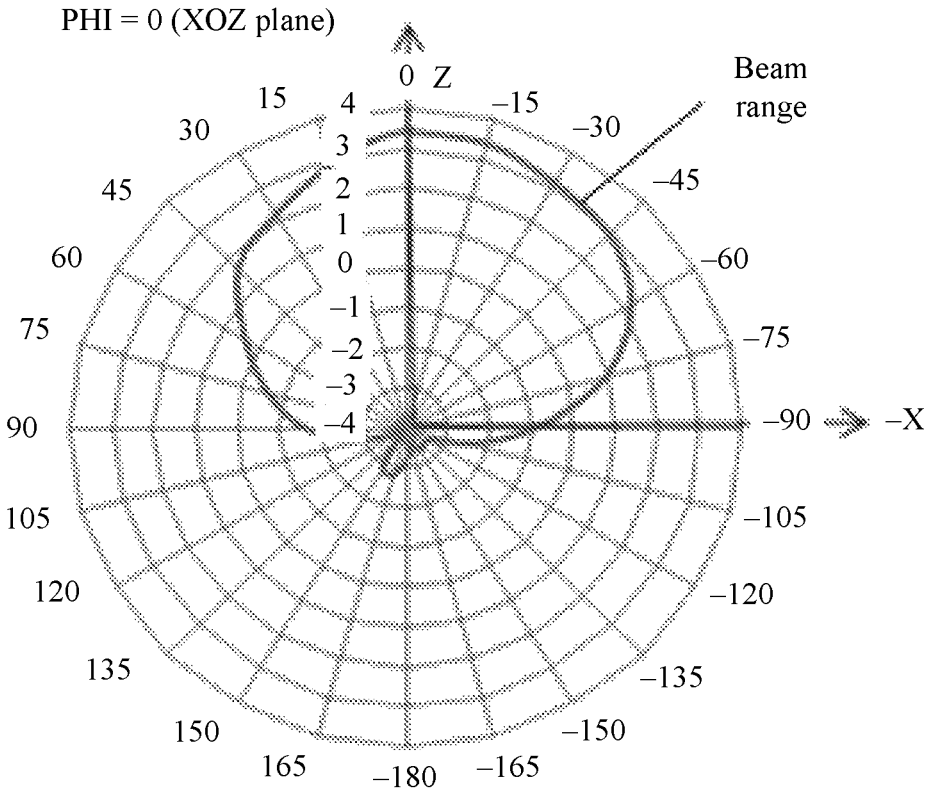
FIG. 3-a

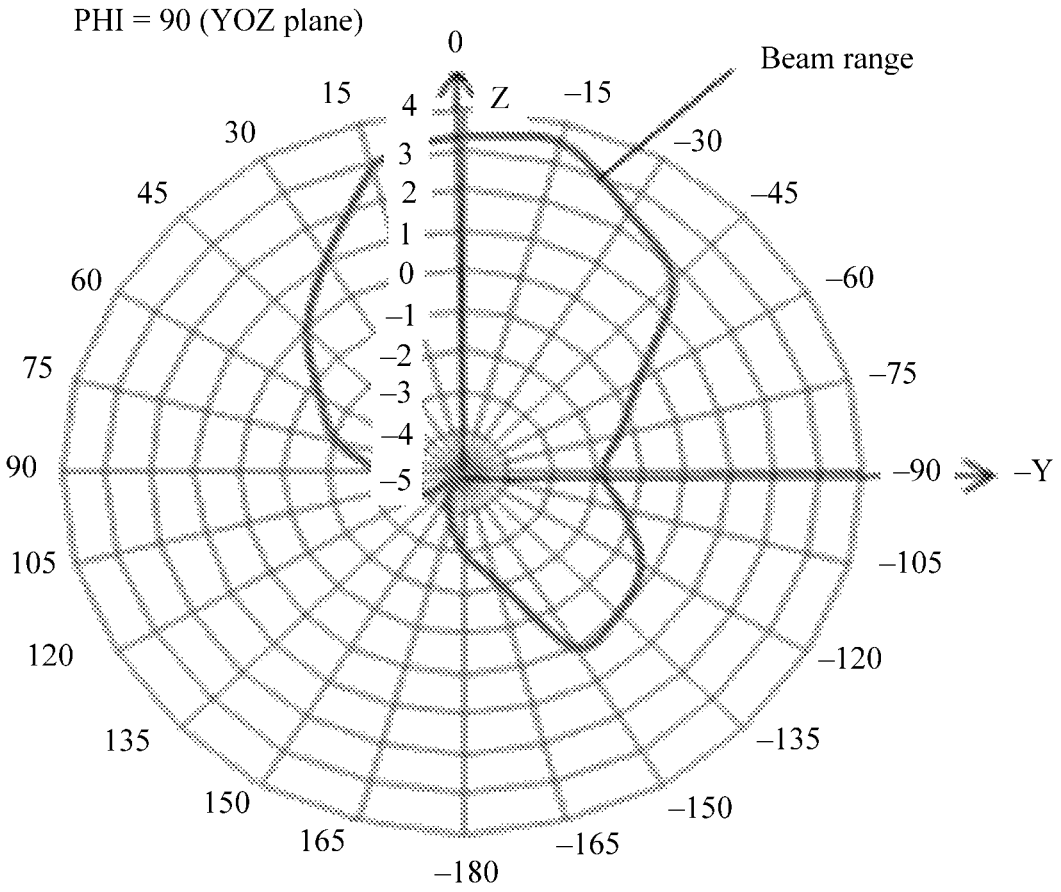
FIG. 3-b

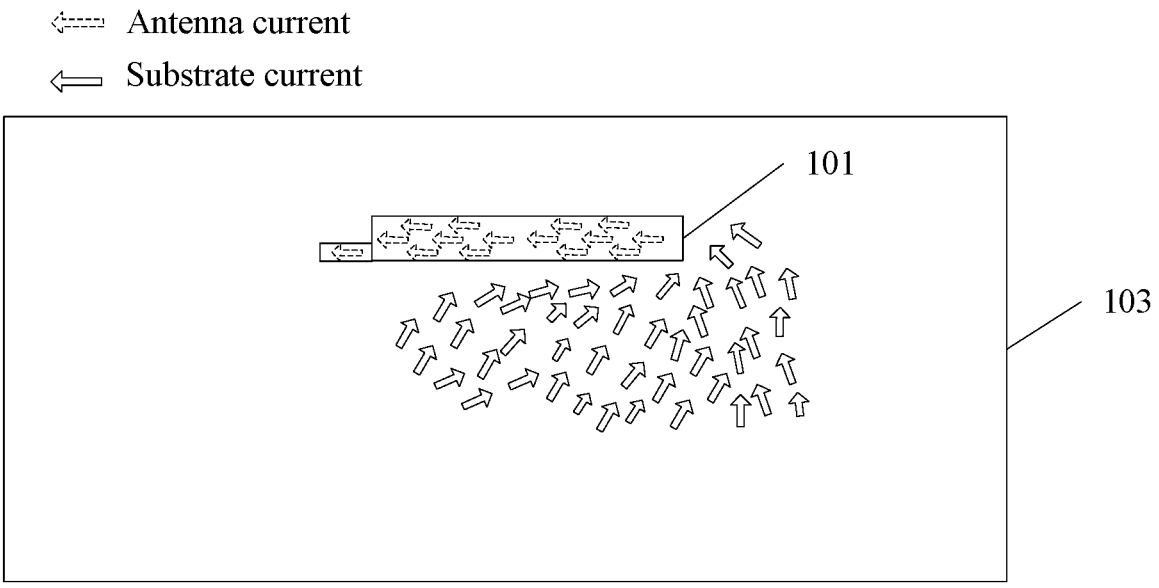
FIG. 4-a
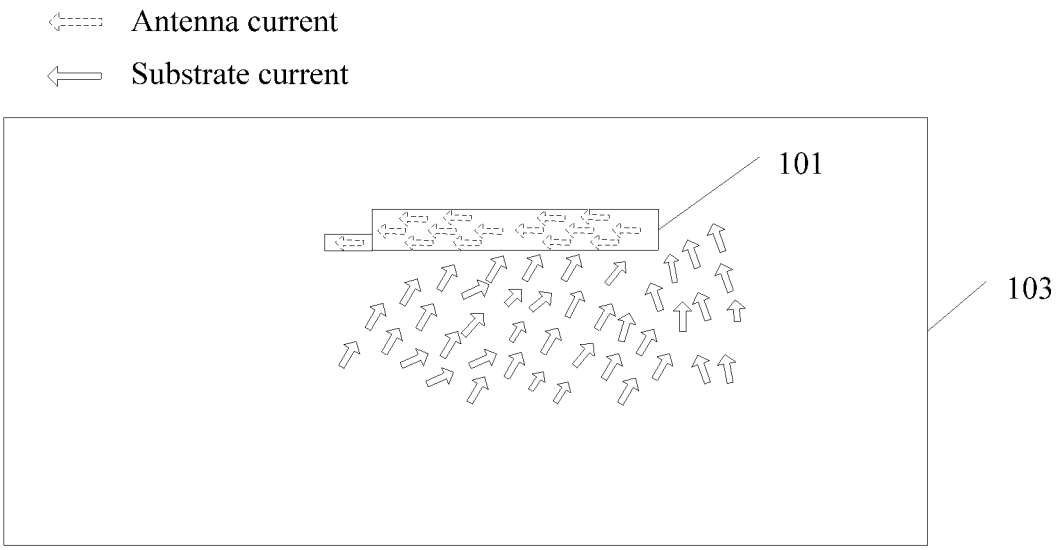
FIG. 4-b

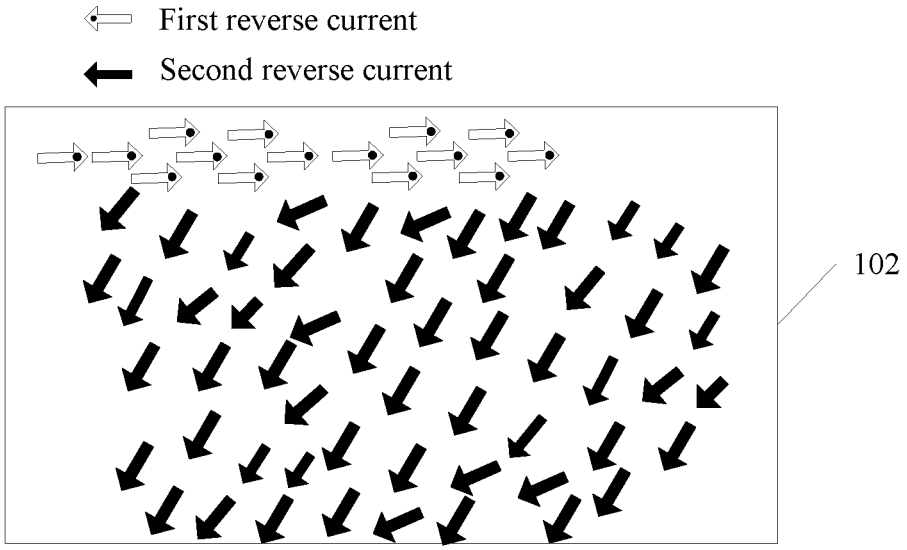
FIG. 4-c

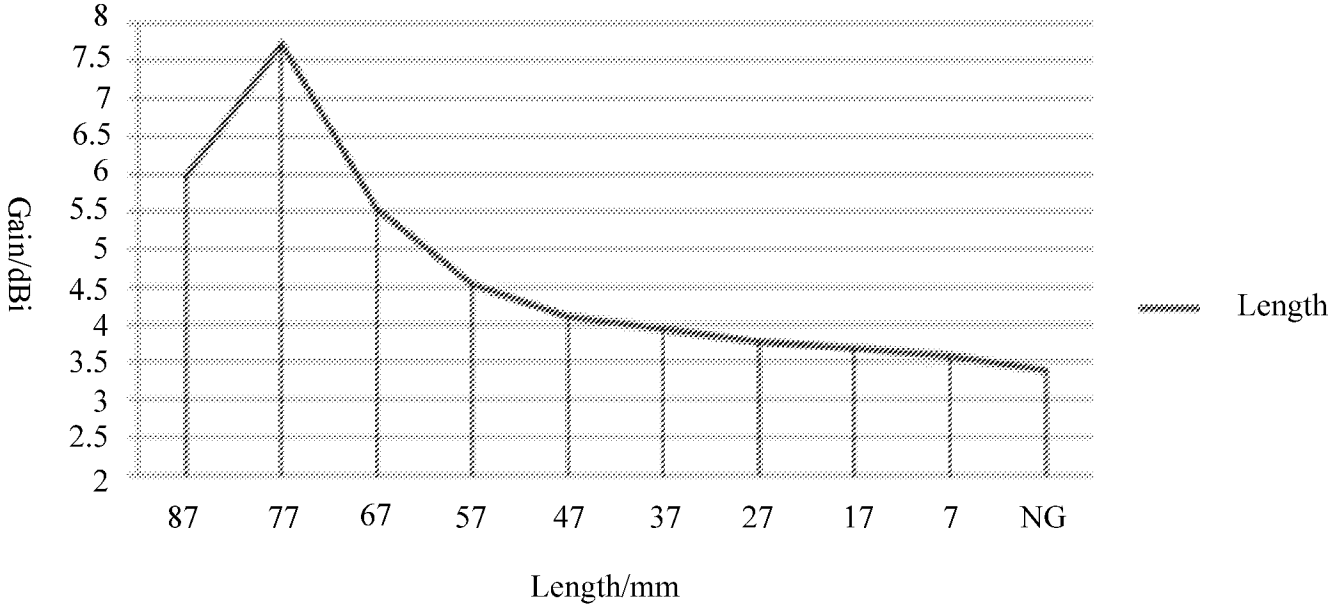
FIG. 5-a

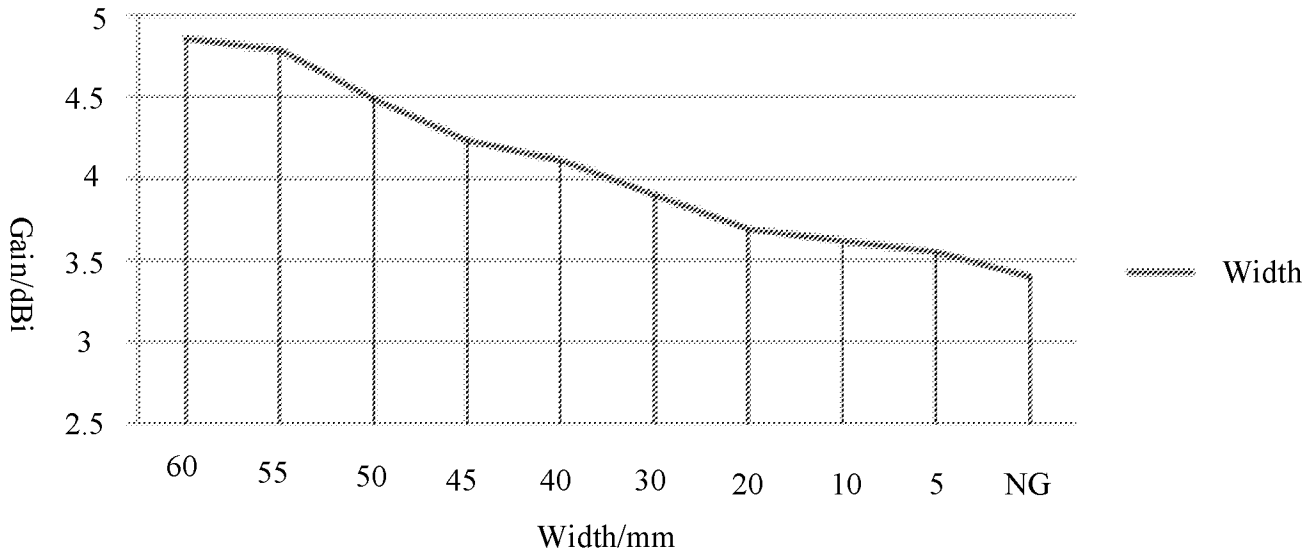
FIG. 5-b

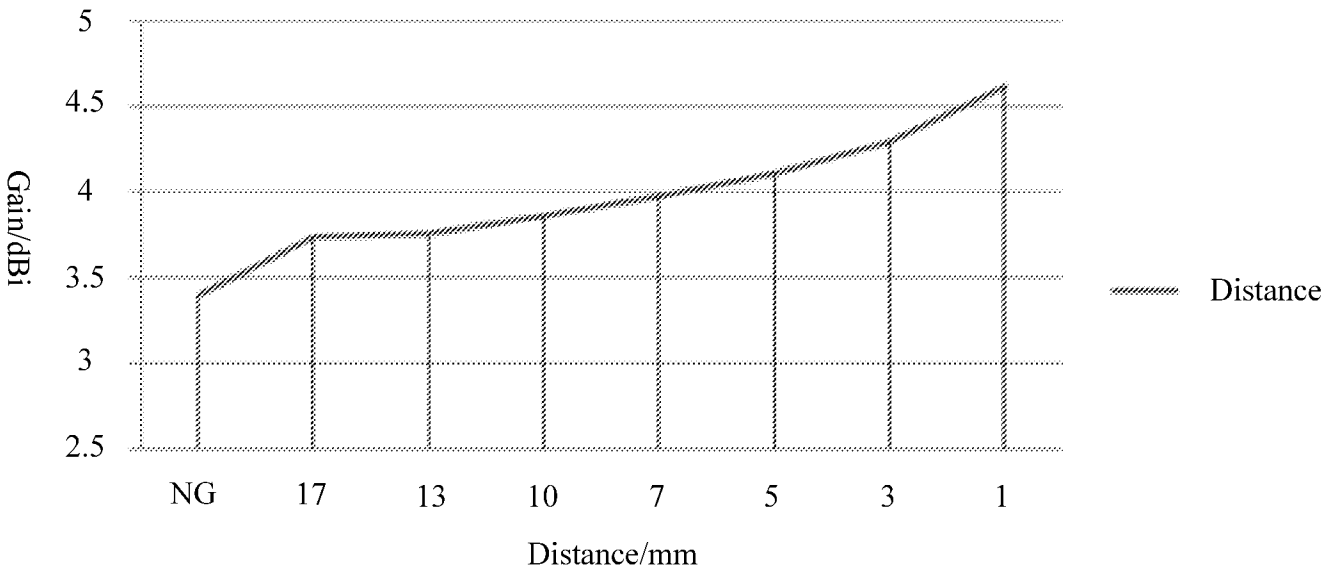
FIG. 5-c

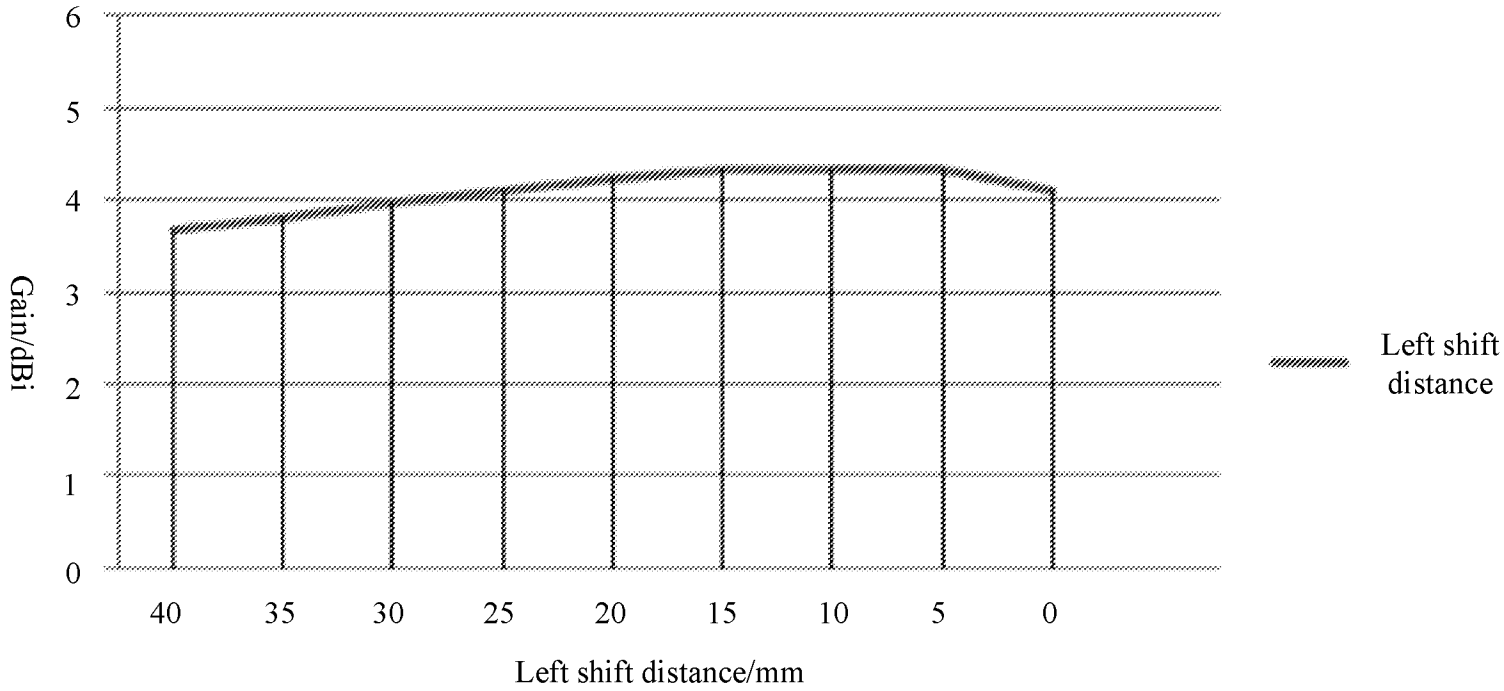
FIG. 5-d

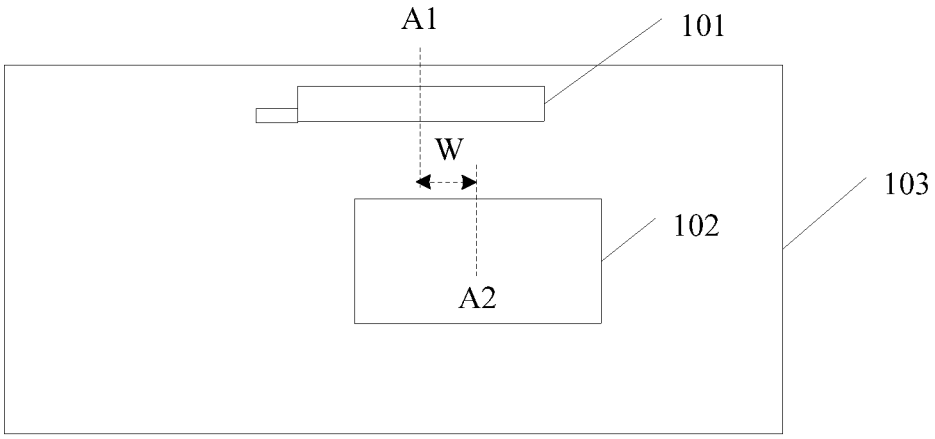
FIG. 5-e

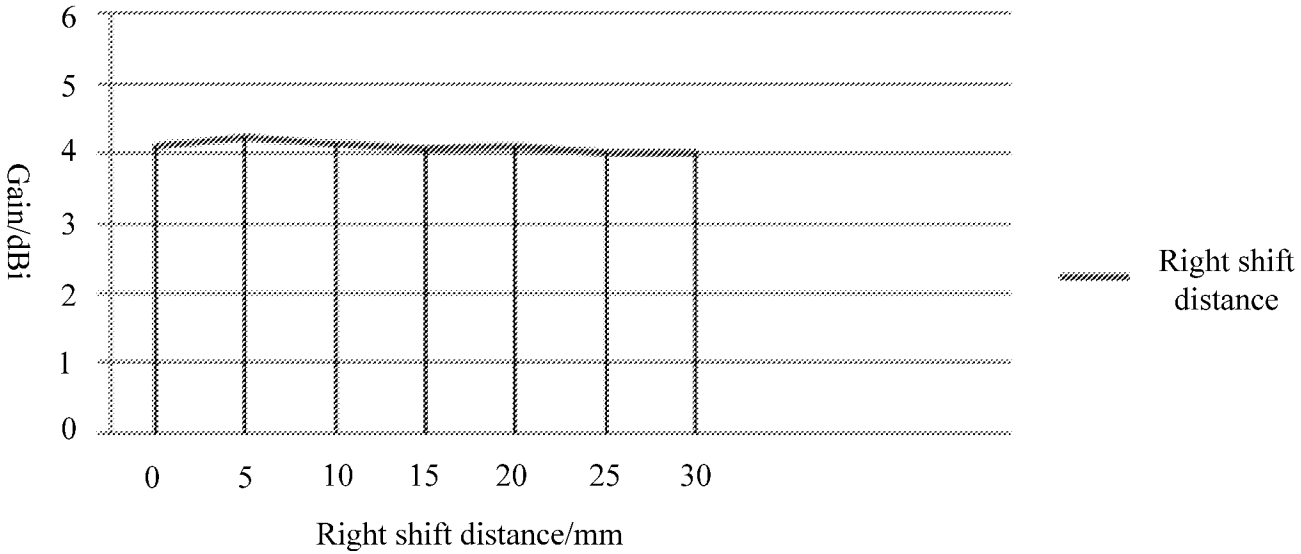
FIG. 5-f

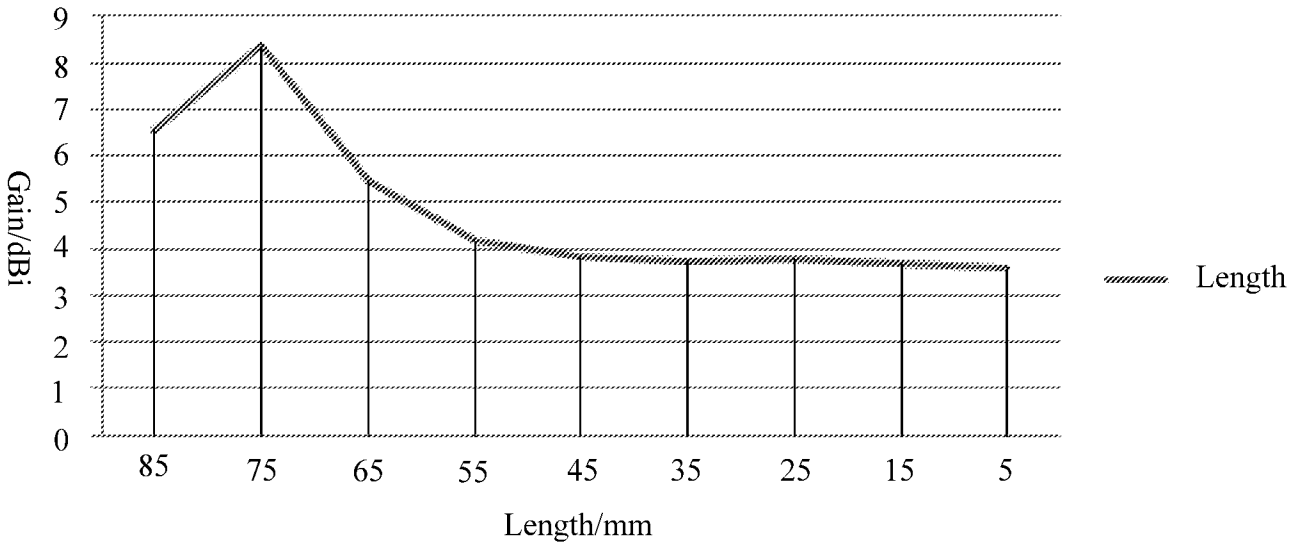
FIG. 6-a

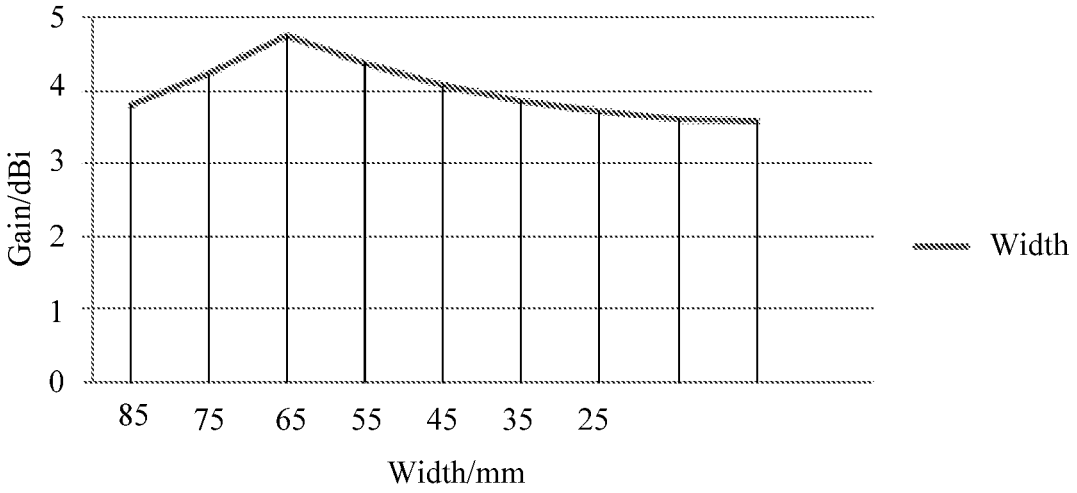
FIG. 6-b
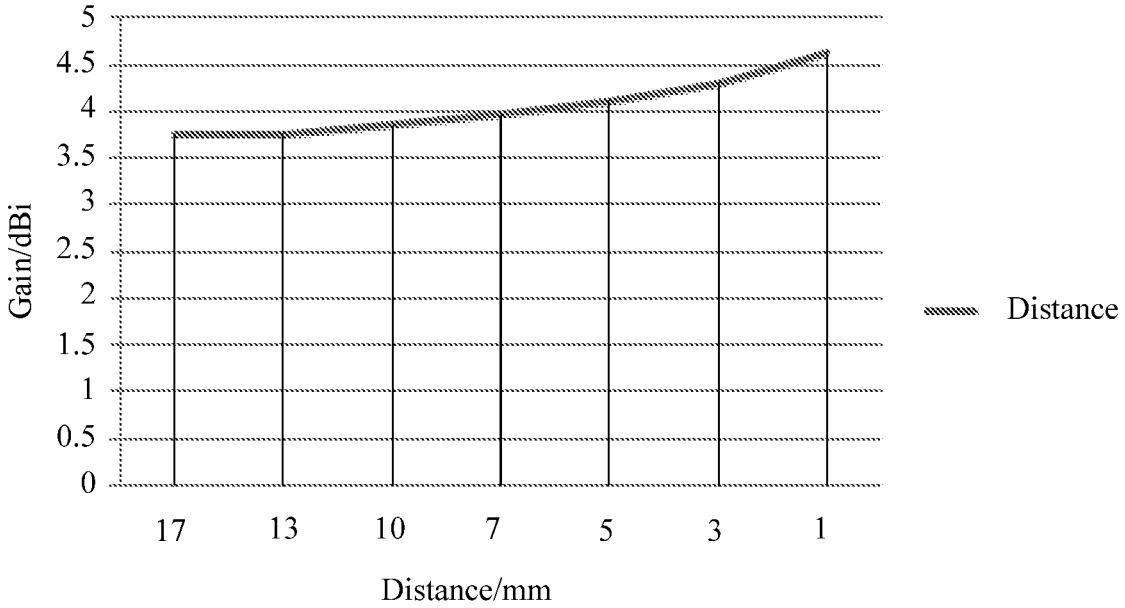
FIG. 6-c

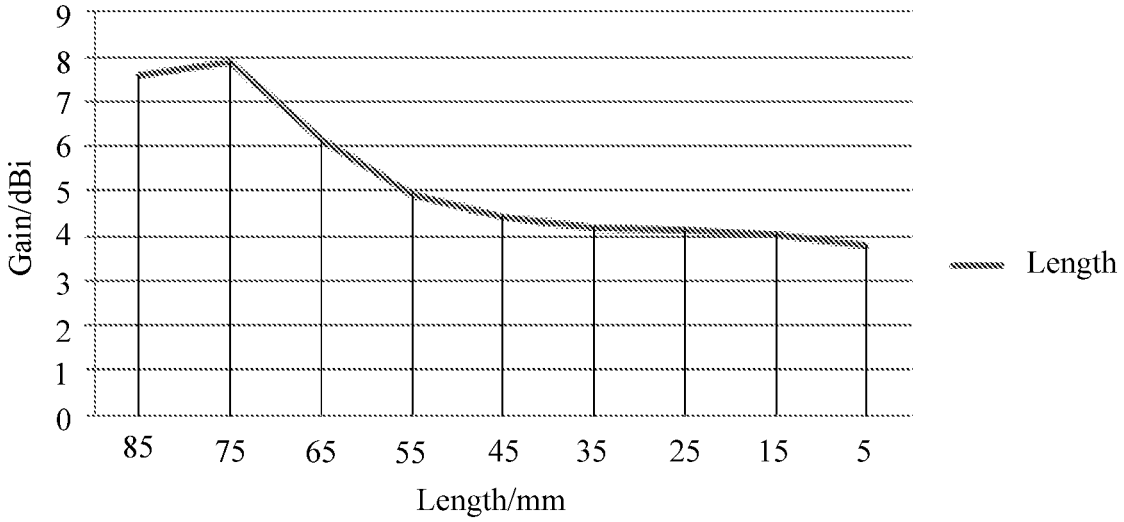
FIG. 7-a
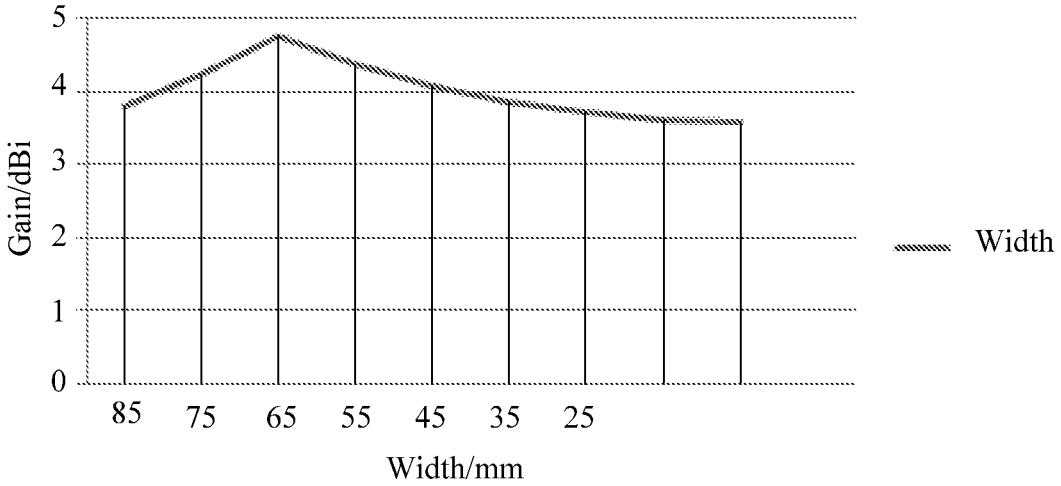
FIG. 7-b

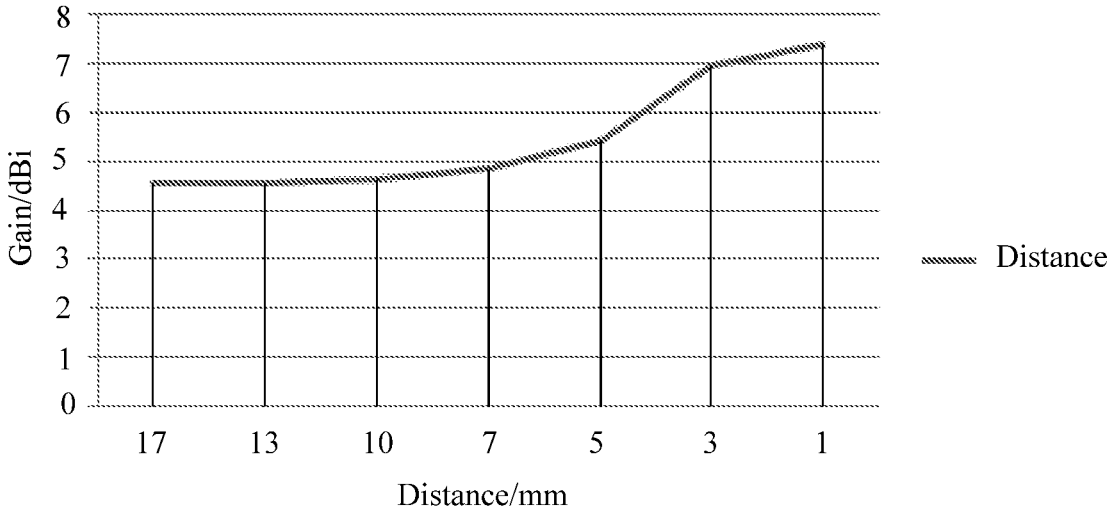
FIG. 7-c

ANTENNA DEVICE AND BEAM DIRECTION ADJUSTMENT METHOD APPLIED TO ANTENNA DEVICE

CROSS-REFERENCE TO RELATED APPLICATIONS

This application is a national stage of International Application No. PCT/CN2016/088550, filed on Jul. 5, 2016, which is hereby incorporated by reference in its entirety.

TECHNICAL FIELD

The present invention relates to the field of communications technologies, and in particular, to an antenna device and a beam direction adjustment method applied to an antenna device.

BACKGROUND

A global positioning system (Global Positioning System, GPS) greatly changes life of users. On an in-vehicle terminal device, an application such as navigation has a higher requirement on GPS performance. A GPS receiver that can receive more ground-plane satellites is better. Therefore, a specific beam width is required in an upper hemisphere directivity pattern (that is, a direction towards the sky) of an antenna. How to improve an upper hemisphere directivity pattern of the GPS is a challenge in GPS antenna design of a terminal.

Currently, a solution using a four-arm helical antenna can achieve a better antenna upper hemisphere beam width. However, such a four-arm helical antenna may generally reach a size of 25 mm (millimeters, mm)×140 mm. Consequently, an antenna volume is excessively large. In addition, if the four-arm helical antenna needs to implement a heart radiation feature of upper half space, a phase difference is required between four feeding ports. The phase difference may be implemented by using different excitation separately performed on four antenna arms. Alternatively, it may be considered that the four-arm helical antenna is formed by two dual-arm helical antennas, and 90-degree orthogonal feeding is used. Currently, the following two feeding methods are widely used: phase-shift network feeding and self-phase-shift feeding. Phase-shift network feeding usually uses a form of a microstrip, a strip line, a coplanar waveguide, and the like, and the microstrip is most used. Phase-shift network feeding is usually formed by a power splitter, a directional combiner, and a phase shifter of 90 degrees/180 degrees through cooperation. For self-phase-shift feeding, a self-phase-shift structure is usually used together with a balun. Consequently, two current feeding systems both have a problem of a relatively complex structure, and are not applicable to a terminal product.

SUMMARY

Embodiments of the present invention provide an antenna device and a beam direction adjustment method applied to an antenna device, so as to improve an antenna directivity pattern of an antenna element without increasing a volume of the antenna device.

According to a first aspect, an embodiment of the present invention provides an antenna device, including an antenna element, a metal element, and a substrate, where the antenna element and the metal element are separately disposed on the substrate, and there is a preset distance between the metal element and the antenna element on the substrate;

the antenna element works at least at a first frequency, a ground point of the metal element is fastened on a pad of the substrate, and the ground point is on a side of the metal element close to the antenna element; and a first reverse current opposite to an antenna current generated by the antenna element is obtained through coupling on the side of the metal element close to the antenna element, and a second reverse current opposite to a substrate current generated by the substrate is obtained through coupling at a lower part of the metal element that is in contact with the substrate, so that a beam width of the antenna element in an upper hemisphere directivity pattern is increased by combining the first reverse current and the antenna current and combination of the second reverse current and the substrate current.

In this embodiment of the present invention, the antenna device includes the antenna element, the metal element, and the substrate. The antenna element and the metal element are separately disposed on the substrate, and there is the preset distance between the metal element and the antenna element on the substrate. The antenna element works at least at the first frequency. In the antenna device provided in this embodiment of the present invention, the metal element is disposed on the substrate, the ground point of the metal element is fastened on the pad of the substrate, and the ground point is on the side of the metal element close to the antenna element. The metal element and the antenna element are separated from each other on the substrate. In addition, the metal element can obtain, through coupling, the first reverse current opposite to the antenna current generated by the antenna element, and can also obtain, through coupling on the metal element, the second reverse current opposite to the substrate current generated by the substrate. The first reverse current and the second reverse current generated by the metal element are respectively combined with the antenna current and the substrate current, so as to reduce a beam width of the antenna element in a direction other than the upper hemisphere directivity pattern. Therefore, the beam width of the antenna element in the upper hemisphere directivity pattern is effectively extended, and the upper hemisphere directivity pattern of the antenna can be effectively improved. In this embodiment of the present invention, only a metal element needs to be deployed in the antenna device, and various complex feeding systems are not required, so that a volume of the antenna device is not increased.

With reference to the first aspect, in a first possible implementation of the first aspect, a length of the metal element is greater than or equal to 0.25λ, and less than or equal to 0.5λ, and λ is a wavelength corresponding to the first frequency. In some embodiments of the present invention, when the length of the metal element is greater than or equal to 0.25λ, and less than or equal to 0.5λ, the metal element improves the beam width of the antenna element in the upper hemisphere directivity pattern more obviously.

With reference to the first aspect, in a second possible implementation of the first aspect, a width of the metal element is greater than or equal to 0.25λ, and less than or equal to 0.5λ, and λ is a wavelength corresponding to the first frequency. In some embodiments of the present invention, when the width of the metal element is greater than or equal to 0.25λ, and less than or equal to 0.5λ, the metal element improves the beam width of the antenna element in the upper hemisphere directivity pattern more obviously.

With reference to the first aspect, in a third possible implementation of the first aspect, the distance between the metal element and the antenna element on the substrate is less than or equal to 7 mm. In some embodiments of the present invention, when the distance between the metal element and the antenna element ranges from 0 mm to 7 mm, the metal element improves the beam width of the antenna element in the upper hemisphere directivity pattern more obviously.

With reference to the first aspect, in a fourth possible implementation of the first aspect, a distance between vertical center lines respectively corresponding to the metal element and the antenna element in a length direction is greater than or equal to 0, and less than or equal to 20 mm. In some embodiments of the present invention, when the distance between the vertical center lines respectively corresponding to the metal element and the antenna element in the length direction ranges from 0 mm to 20 mm, the metal element improves the beam width of the antenna element in the upper hemisphere directivity pattern more obviously.

With reference to the first aspect, in a fifth possible implementation of the first aspect, a difference between heights of the metal element and the antenna element that are relative to a plane on which the substrate is located is greater than or equal to 0, and less than or equal to 5 mm. In some embodiments of the present invention, when the difference between the heights of the metal element and the antenna element that are relative to the plane on which the substrate is located ranges from 0 mm to 5 mm, the metal element improves the beam width of the antenna element in the upper hemisphere directivity pattern more obviously.

With reference to any one of the first aspect, or the first to the fifth possible implementations of the first aspect, in a sixth possible implementation of the first aspect, the metal element is a battery component disposed on the substrate. In some embodiments of the present invention, the metal element may be implemented by using a battery metal enclosure in the battery component, so as to complete a function of the metal element in this embodiment of the present invention by using an existing battery component in the antenna device instead of adding an additional component.

With reference to any one of the first aspect, or the first to the fifth possible implementations of the first aspect, in a seventh possible implementation of the first aspect, the substrate is a printed circuit board PCB.

According to a second aspect, an embodiment of the present invention further provides a beam direction adjustment method applied to an antenna device, where the antenna device includes an antenna element, a metal element, and a substrate, the antenna element works at least at a first frequency, a ground point of the metal element is fastened on a pad of the substrate, and the ground point is on a side of the metal element close to the antenna element; and the method includes the following steps:

separately disposing the antenna element and the metal element on the substrate, where the metal element is separated from the antenna element on the substrate by a preset distance; obtaining, through coupling on the side of the metal element close to the antenna element, a first reverse current opposite to an antenna current generated by the antenna element; and obtaining, through coupling at a lower part of the metal element that is in contact with the substrate, a second reverse current opposite to a substrate current generated by the substrate, so that a beam width of the antenna element in an upper hemisphere directivity pattern is increased by combining the first reverse current and the antenna current and combination of the second reverse current and the substrate current.

In this embodiment of the present invention, the antenna device includes the antenna element, the metal element, and the substrate. The antenna element and the metal element are separately disposed on the substrate, and there is the preset distance between the metal element and the antenna element on the substrate. The antenna element works at least at the first frequency. In the antenna device provided in this embodiment of the present invention, the metal element is disposed on the substrate, the ground point of the metal element is fastened on the pad of the substrate, and the ground point is on the side of the metal element close to the antenna element. The metal element and the antenna element are separated from each other on the substrate. In addition, the metal element can obtain, through coupling, the first reverse current opposite to the antenna current generated by the antenna element, and can also obtain, through coupling on the metal element, the second reverse current opposite to the substrate current generated by the substrate. The first reverse current and the second reverse current generated by the metal element are respectively combined with the antenna current and the substrate current, so as to reduce a beam width of the antenna element in a direction other than the upper hemisphere directivity pattern. Therefore, the beam width of the antenna element in the upper hemisphere directivity pattern is effectively extended, and the upper hemisphere directivity pattern of the antenna can be effectively improved. In this embodiment of the present invention, only a metal element needs to be deployed in the antenna device, and various complex feeding systems are not required, so that a volume of the antenna device is not increased.

With reference to the second aspect, in a first possible implementation of the second aspect, the method further includes: adjusting a length of the metal element to be greater than or equal to 0.25λ, and less than or equal to 0.5λ, where λ is a wavelength corresponding to the first frequency. In some embodiments of the present invention, when the length of the metal element is greater than or equal to 0.25λ, and less than or equal to 0.5λ, the metal element improves the beam width of the antenna element in the upper hemisphere directivity pattern more obviously.

With reference to the second aspect, in a second possible implementation of the second aspect, the method further includes: adjusting a width of the metal element to be greater than or equal to 0.25λ, and less than or equal to 0.5λ, where λ is a wavelength corresponding to the first frequency. In some embodiments of the present invention, when the width of the metal element is greater than or equal to 0.25λ, and less than or equal to 0.5λ, the metal element improves the beam width of the antenna element in the upper hemisphere directivity pattern more obviously.

With reference to the second aspect, in a third possible implementation of the second aspect, the method further includes: adjusting the distance between the metal element and the antenna element on the substrate to be less than or equal to 7 mm. In some embodiments of the present invention, when the distance between the metal element and the antenna element ranges from 0 mm to 7 mm, the metal element improves the beam width of the antenna element in the upper hemisphere directivity pattern more obviously.

With reference to any one of the second aspect, or the first to the third possible implementations of the second aspect, in a fourth possible implementation of the second aspect, the method further includes: adjusting a distance between vertical center lines respectively corresponding to the metal element and the antenna element in a length direction to be greater than or equal to 0, and less than or equal to 20 mm. In some embodiments of the present invention, when the distance between the vertical center lines respectively corresponding to the metal element and the antenna element in the length direction ranges from 0 mm to 20 mm, the metal element improves the beam width of the antenna element in the upper hemisphere directivity pattern more obviously.

With reference to any one of the second aspect, or the first to the third possible implementations of the second aspect, in a fifth possible implementation of the second aspect, the method further includes: adjusting a difference between heights of the metal element and the antenna element that are relative to a plane on which the substrate is located to be greater than or equal to 0, and less than or equal to 5 mm. In some embodiments of the present invention, when the difference between the heights of the metal element and the antenna element that are relative to the plane on which the substrate is located ranges from 0 mm to 5 mm, the metal element improves the beam width of the antenna element in the upper hemisphere directivity pattern more obviously.

BRIEF DESCRIPTION OF THE DRAWINGS

FIG. 1 is a schematic structural composition diagram of an antenna device according to an embodiment of the present invention;

FIG. 2-*a* is a schematic diagram of an XOZ-plane antenna direction of an antenna device not provided with a metal element;

FIG. 2-*b* is a schematic diagram of a YOZ-plane antenna direction of an antenna device not provided with a metal element;

FIG. 3-*a* is a schematic diagram of an XOZ-plane antenna direction of an antenna device provided with a metal element according to an embodiment of the present invention;

FIG. 3-*b* is a schematic diagram of a YOZ-plane antenna direction of an antenna device provided with a metal element according to an embodiment of the present invention;

FIG. 4-*a* is a schematic diagram of analog current directions on an antenna element and a substrate in an antenna device not provided with a metal element;

FIG. 4-*b* is a schematic diagram of analog current directions on an antenna element and a substrate in an antenna device provided with a metal element according to an embodiment of the present invention;

FIG. 4-*c* is a schematic diagram of an analog current direction in a metal element according to an embodiment of the present invention;

FIG. 5-*a* is a schematic gain curve diagram in which a gain of an antenna element varies with a length of a metal element according to an embodiment of the present invention;

FIG. 5-*b* is a schematic gain curve diagram in which a gain of an antenna element varies with a width of a metal element according to an embodiment of the present invention;

FIG. 5-*c* is a schematic gain curve diagram in which a gain of an antenna element varies with a distance between a metal element and the antenna element according to an embodiment of the present invention;

FIG. 5-*d* is a schematic gain curve diagram in which a gain of an antenna element varies with a left shift of a distance between vertical center lines respectively corresponding to a metal element and the antenna element in a length direction according to an embodiment of the present invention;

FIG. 5-*e* is a left shifting location relationship diagram of a distance between vertical center lines respectively corresponding to a metal element and an antenna element in a length direction according to an embodiment of the present invention;

FIG. 5-*f* is a schematic gain curve diagram in which a gain of an antenna element varies with a right shift of a distance between vertical center lines respectively corresponding to a metal element and the antenna element in a length direction according to an embodiment of the present invention;

FIG. 6-*a* is another schematic gain curve diagram in which a gain of an antenna element varies with a length of a metal element according to an embodiment of the present invention;

FIG. 6-*b* is another schematic gain curve diagram in which a gain of an antenna element varies with a width of a metal element according to an embodiment of the present invention;

FIG. 6-*c* is another schematic gain curve diagram in which a gain of an antenna element varies with a distance between a metal element and the antenna element according to an embodiment of the present invention;

FIG. 7-*a* is another schematic gain curve diagram in which a gain of an antenna element varies with a length of a metal element according to an embodiment of the present invention;

FIG. 7-*b* is another schematic gain curve diagram in which a gain of an antenna element varies with a width of a metal element according to an embodiment of the present invention; and FIG. 7-*c* is another schematic gain curve diagram in which a gain of an antenna element varies with a distance between a metal element and the antenna element according to an embodiment of the present invention.

DETAILED DESCRIPTION OF ILLUSTRATIVE EMBODIMENTS

Embodiments of the present invention provide an antenna device and a beam direction adjustment method applied to an antenna device, so as to improve an antenna directivity pattern of an antenna element without increasing a volume of the antenna device.

To make the invention objectives, features, and advantages of the present invention clearer and more comprehensible, the following clearly and completely describes the technical solutions in the embodiments of the present invention with reference to the accompanying drawings in the embodiments of the present invention. Apparently, the embodiments described in the following are merely a part rather than all of the embodiments of the present invention. All other embodiments obtained by persons skilled in the art based on the embodiments of the present invention shall fall within the protection scope of the present invention.

In the specification, claims, and the foregoing drawings, the terms "include", "contain" and any other variants mean to cover the non-exclusive inclusion, so that a process, method, system, product, or device that includes a series of units is not necessarily limited to those units, but may include other units not expressly listed or inherent to such a process, method, system, product, or device.

Details are separately illustrated in the following. First, the antenna device provided in the embodiments of the present invention is described. The antenna device can extend a beam width in an upper hemisphere directivity pattern. Referring to FIG. 1, an antenna device provided in an embodiment of the present invention may include an antenna element 101, a metal element 102, and a substrate 103.

The antenna element 101 and the metal element 102 are separately disposed on the substrate 103, and there is a preset distance between the metal element 102 and the antenna element 101 on the substrate 103.

The antenna element 101 works at least at a first frequency, a ground point of the metal element 102 is fastened on a pad of the substrate 103, and the ground point is on a side of the metal element 102 close to the antenna element 101.

A first reverse current opposite to an antenna current generated by the antenna element 101 is obtained through coupling on the side of the metal element 102 close to the antenna element 101, and a second reverse current opposite to a substrate current generated by the substrate 103 is obtained through coupling at a lower part of the metal element 102 that is in contact with the substrate 103, so that a beam width of the antenna element 101 in an upper hemisphere directivity pattern is increased by combining the first reverse current and the antenna current and combination of the second reverse current and the substrate current.

As shown in FIG. 1, there is the preset distance between the antenna element 101 and the metal element 102, and the distance is indicated by H in FIG. 1. In addition, the ground point of the metal element 102 is fastened on the pad of the substrate 103, and the ground point is on the side of the metal element 102 close to the antenna element 101. It can be understood that the antenna element 101 shown in FIG. 1 generates the antenna current in a length direction, and the substrate generates the substrate current in a length direction. An example in which the antenna element 101 and the metal element 102 are horizontally disposed is used for illustration in FIG. 1. In actual application, a location relationship between the antenna element 101, the metal element 102, and the substrate 103 may be adjusted according to an actual scenario. In this embodiment of the present invention, the ground point of the metal element 102 is connected to the substrate 103, and the metal element 102 separately generates the first reverse current and the second reverse current. The first reverse current is combined with the antenna current, and the second reverse current is combined with the substrate current, so that an upper hemisphere beam width of an antenna directivity pattern is effectively increased.

It should be noted that in this embodiment of the present invention, the antenna device may be applied to a terminal product. The antenna element 101 included in the antenna device is an antenna that radiates an electromagnetic wave. The antenna element works at least at the first frequency, and a working frequency of the antenna element may be flexibly selected with reference to an application scenario. The metal element 102 may be a metal piece product that can conduct a current. For example, the metal element 102 is a metal sheet, a metal enclosure, or a metal strip. The metal element 102 may be made of various types of metal, such as copper or iron. In this embodiment of the present invention, the antenna element 101 is disposed on the substrate 103, and a direction of the antenna element 101 is described by using a hemisphere directivity pattern. In this embodiment of the present invention, the metal element 102 is disposed to be separated from the antenna element 101 by a distance (indicated by "H" in the figure) on the substrate 103 according to a location of the antenna element 101. The metal element 102 is also disposed on the substrate 103, and a distance is maintained between the metal element 102 and the antenna element 101. In this case, after the antenna device is powered on, the antenna element 101 generates the antenna current, the substrate 103 generates the substrate current, and the metal element 102 generates the first reverse current and the second reverse current according to a coupling relationship between the metal element 102 and the antenna element 101. As described above, the first reverse current opposite to the antenna current generated by the antenna element 101 is obtained through coupling on the side of the metal element 102 close to the antenna element 101, and the second reverse current opposite to the substrate current generated by the substrate 103 is obtained through coupling at the lower part of the metal element 102 that is in contact with the substrate 103. The antenna element 101 generates a radiation beam around a center frequency of the antenna element 101, and the beam covers a specific range. The metal element 102 can effectively improve the beam width of the antenna element 101 in the upper hemisphere directivity pattern by using the combination of the first reverse current and the antenna current and the combination of the second reverse current and the substrate current, so that beam coverage of the antenna element 101 is effectively increased in a direction towards the sky.

It should be noted that in the antenna device provided in this embodiment of the present invention, the beam width of the antenna element 101 in the upper hemisphere directivity pattern can be increased as long as there is a distance between the metal element 102 and the antenna element 101 on the substrate 103 in a vertical direction. The distance, the antenna element 101, and the metal element 102 may be specifically implemented with reference to a specific application scenario. For details, refer to descriptions in subsequent embodiments.

It can be learned from illustration of the foregoing embodiment of the present invention that the antenna device includes the antenna element, the metal element, and the substrate. The antenna element and the metal element are separately disposed on the substrate, and there is the preset distance between the metal element and the antenna element on the substrate. In the antenna device provided in this embodiment of the present invention, the metal element is disposed on the substrate. The metal element and the antenna element are separated from each other on the substrate. In addition, the metal element can obtain, through coupling, the first reverse current opposite to the antenna current generated by the antenna element, and can also obtain, through coupling on the metal element, the second reverse current opposite to the substrate current generated by the substrate. The first reverse current and the second reverse current generated by the metal element are respectively combined with the antenna current and the substrate current, so as to reduce a beam width of the antenna element in a direction other than the upper hemisphere directivity pattern. Therefore, the beam width of the antenna element in the upper hemisphere directivity pattern is effectively extended, and the upper hemisphere directivity pattern of the antenna can be effectively improved. In this embodiment of the present invention, only a metal element needs to be deployed in the antenna device, and various complex feeding systems are not required, so that a volume of the antenna device is not increased.

To better understand and implement the foregoing solution in this embodiment of the present invention, a corresponding application scenario is used as an example in the following detailed description. The following describes the antenna device provided in this embodiment of the present invention by using an example in some other embodiments. In this embodiment of the present invention, the metal element can be directly used to improve an antenna directivity pattern and an antenna gain of the antenna element. Specifically, in the antenna device provided in this embodiment of the present invention, an antenna beam width in an upper hemisphere directivity pattern can be effectively improved by directly using the metal element, and receiving performance of the antenna device can be effectively enhanced. In actual application, the antenna device provided in this embodiment of the present invention may be applied to a terminal product, and the product may be in a rectangular layout. As shown in FIG. 1, the antenna element may be specifically a GPS antenna. The antenna element may be disposed at an upper middle part of the substrate. The GPS antenna may be an inverted-F antenna (Inverted-F Antenna, IFA), and the IFA is referred to as the inverted-F antenna due to a shape of an inverted letter F. The metal element is disposed at a lower part of the antenna element. There is a distance between the metal element and the antenna element.

The following describes, according to whether a metal element is disposed in the antenna device, a role played by the metal element in improving a beam width of the antenna element in an upper hemisphere directivity pattern in an embodiment of the present invention. Referring to FIG. 2-*a*, FIG. 2-*a* is a schematic diagram of an XOZ-plane antenna direction of an antenna device not provided with a metal element. Referring to FIG. 2-*b*, FIG. 2-*b* is a schematic diagram of a YOZ-plane antenna direction of an antenna device not provided with a metal element. A PHI indicates an oblique angle. FIG. 2-*a* is an XOZ-plane beam range. FIG. 2-*b* is a YOZ-plane beam range. In FIG. 2-*a*, a beam width above an X axis belongs to an upper hemisphere beam range. In FIG. 2-*b*, a beam width above a Y axis belongs to an upper hemisphere beam range. Actual measurement is performed on the antenna device not provided with a metal element, to obtain data of the antenna device not provided with a metal element shown in the following Table 1.

| Antenna device not provided with a metal element | | | |
|---|---|---|---|
| Frequency (Frequency) (Unit: MHz) | Efficiency (Efficiency) (Unit: dB) | Efficiency (Unit: %) | Gain (Gain) (Unit: dBi) |
| 1575 | −0.33 | 92.61 | 3.18 |

Referring to FIG. 3-*a*, FIG. 3-*a* is a schematic diagram of an XOZ-plane antenna direction of an antenna device provided with a metal element according to an embodiment of the present invention. Referring to FIG. 3-*b*, FIG. 3-*b* is a schematic diagram of a YOZ-plane antenna direction of an antenna device provided with a metal element according to an embodiment of the present invention. Actual measurement is performed on the antenna device provided with a metal element, to obtain data of the antenna device provided with a metal element shown in the following Table 2.

| Antenna device provided with a metal element | | | |
|---|---|---|---|
| Frequency (MHz) | Efficiency (dB) | Efficiency (%) | Gain (dBi) |
| 1575 | −0.79 | 83.34 | 3.74 |

It can be learned by using comparison between FIG. 2-*a* and FIG. 3-*a* and comparison between FIG. 2-*b* and FIG. 3-*b* that antenna upper hemisphere beam widths are obviously improved on both planes on which PHI=0 and PHI=90°. For example, by using the comparison between FIG. 2-*a* and FIG. 3-*a*, a beam width, belonging to an upper hemisphere beam range, above an X axis on a plane on which PHI=0 in FIG. 3-*a* is greater than a beam width, belonging to an upper hemisphere beam range, above an X axis on a plane on which PHI=0 in FIG. 2-*a*. For another example, by using the comparison between FIG. 2-*b* and FIG. 3-*b*, a beam width, belonging to an upper hemisphere beam range, above a Y axis on a plane on which PHI=90 in FIG. 3-*b* is greater than a beam width, belonging to an upper hemisphere beam range, above a Y axis on a plane on which PHI=90 in FIG. 2-*b*.

It can be learned by using comparison between Table 1 and Table 2 that, the antenna gain is increased after the metal element is disposed. In addition, actual measurement indicates that an S parameter of an antenna is not affected before and after the metal element is disposed in the antenna device. An S11 parameter of the antenna indicates a return loss feature, and the S11 parameter is not offset before and after the metal element is disposed in the antenna device.

It can be learned by using emulation description of the present invention and according to an emulation result that, after the metal element is appended to the antenna device, a first reverse current opposite to an antenna current is obtained through coupling on a side (that is, a side close to the antenna element) of the metal element, and a second reverse current opposite to a substrate current is obtained through coupling at a lower part of the metal element, so that the upper hemisphere directivity pattern is improved by using combination.

Referring to FIG. 4-*a*, FIG. 4-*a* is a schematic diagram of an analog current direction in an antenna device not provided with a metal element according to an embodiment of the present invention. In the antenna device not provided with a metal element, an antenna element generates an antenna current, and a substrate generates a substrate current. Referring to FIG. 4-*b*, FIG. 4-*b* is a schematic diagram of analog current directions on an antenna element and a substrate in an antenna device provided with a metal element according to an embodiment of the present invention. FIG. 4-*c* is a schematic diagram of an analog current direction in a metal element according to an embodiment of the present invention. In FIG. 4-*a*, an example in which a right end of the antenna element is a feed end and a left end of the antenna element is a radiation end is used. The antenna current shifts from right to left. The antenna element radiates energy at the radiation end. The substrate current generated on the substrate shifts from left to right. FIG. 4-*b* shows the antenna device provided with a metal element. For ease of describing a first reverse current and a second reverse current generated by the metal element, the metal element is not shown in FIG. 4-*b*, and a reverse current generated by the metal element may be shown in FIG. 4-*c*. In the antenna device provided with a metal element, the antenna element generates an antenna current, the substrate generates a substrate current, and the metal element generates the first reverse current and the second reverse current. The first reverse current is combined with the antenna current, and the second reverse current is combined with the substrate current, so that a beam width of the antenna element in an upper hemisphere directivity pattern is improved by using the first reverse current and the second reverse current generated by the metal element. After the metal element is disposed in the antenna device, the first reverse current and the second reverse current generated through coupling induction by the metal element are respectively combined with the antenna current and the substrate current.

The following further describes the antenna device provided in this embodiment of the present invention, for example, may describe a size of the metal element, and a distance between the metal element and the antenna element.

In some embodiments of the present invention, a length of the metal element is greater than or equal to 0.25λ, and less than or equal to 0.5λ, and λ is a wavelength corresponding to the first frequency. It should be noted that, when the length of the metal element is greater than or equal to 0.25λ, and less than or equal to 0.5λ, the metal element improves the beam width of the antenna element in the upper hemisphere directivity pattern more obviously. For example, the length of the metal element may be equal to 0.4λ. However, the length of the metal element in the antenna device provided in this embodiment of the present invention may be not limited to 0.5λ. For example, the length of the metal element may be equal to 0.53λ, or equal to 0.6λ, and is specifically determined with reference to an application scenario.

In some other embodiments of the present invention, a length of the metal element is greater than or equal to 5 mm, and less than or equal to 77 mm. For example, the length of the metal element may be 5 mm, 22 mm, or 77 mm. It should be noted that, when the length of the metal element ranges from 5 mm to 77 mm, the metal element improves the beam width of the antenna element in the upper hemisphere directivity pattern more obviously. However, the length of the metal element in the antenna device provided in this embodiment of the present invention may be not limited to the foregoing length range. For example, the length of the metal element may be equal to 3 mm, or equal to 80 mm. In these cases, it only needs to be ensured that there is a distance between the metal element and the antenna element in this embodiment of the present invention, so that the beam width of the antenna element in the upper hemisphere directivity pattern can be improved.

An example in which the antenna element is specifically a GPS antenna is used in the following for description. In a first working frequency band corresponding to the GPS antenna, λ=190 mm. As shown in FIG. 5-*a*, FIG. 5-*a* is a schematic gain curve diagram in which a gain of an antenna element varies with a length of a metal element according to an embodiment of the present invention, where NG indicates that the length is 0 (indicating no metal element). In FIG. 5-*a*, an antenna gain curve is obtained by adjusting the length of the metal element for a plurality of times when a width of the metal element is 40 mm and a distance between the metal element and the antenna element is 5 mm. For example, 47 mm is an optional length of the metal element in this embodiment of the present invention. It can be learned from an emulation result that an antenna gain constantly increases as the length of the metal element increases, but the antenna gain starts to decrease when the length reaches 77 mm. Therefore, to achieve an optimal effect, the length of the metal element may be greater than or equal to 0.25λ, and less than or equal to 0.5λ.

In some embodiments of the present invention, a width of the metal element is greater than or equal to 0.25λ, and less than or equal to 0.5λ, and λ is a wavelength corresponding to the first frequency. It should be noted that, when the width of the metal element is greater than or equal to 0.25λ, and less than or equal to 0.5λ, the metal element improves the beam width of the antenna element in the upper hemisphere directivity pattern more obviously. However, the width of the metal element in the antenna device provided in this embodiment of the present invention may be not limited to 0.5λ. For example, the width of the metal element may be equal to 0.53λ, or a length of the metal element is equal to 0.6λ, and is specifically determined with reference to an application scenario.

In some embodiments of the present invention, a width of the metal element may range from 5 mm to 60 mm. It should be noted that, when the width of the metal element ranges from 5 mm to 60 mm, the metal element improves the beam width of the antenna element in the upper hemisphere directivity pattern more obviously. However, the width of the metal element in the antenna device provided in this embodiment of the present invention may be not limited to the foregoing width range. For example, the width of the metal element may be equal to 3 mm, or equal to 72 mm. In these cases, it only needs to be ensured that there is a distance between the metal element and the antenna element in this embodiment of the present invention, so that the beam width of the antenna element in the upper hemisphere directivity pattern can be improved. An example in which the antenna element is specifically a GPS antenna is used in the following for description. In a frequency band corresponding to the GPS antenna, λ=190 mm. As shown in FIG. 5-*b*, FIG. 5-*b* is a schematic gain curve diagram in which a gain of an antenna element varies with a width of a metal element according to an embodiment of the present invention. In FIG. 5-*b*, an antenna gain curve is obtained by adjusting the width of the metal element for a plurality of times when a length of the metal element is 47 mm and a distance between the metal element and the antenna element is 5 mm. For example, NG indicates that the length is 0 (indicating no metal element), and 40 mm is an optional width of the metal element in this embodiment of the present invention. It can be learned from an emulation result that an antenna gain constantly increases as the width increases. However, an effect in which the antenna gain constantly increases as the width increases is inferior to an effect in which the antenna gain constantly increases as the length of the metal element increases.

In some embodiments of the present invention, the distance between the metal element and the antenna element on the substrate is less than or equal to 7 mm. It should be noted that, when the distance between the metal element and the antenna element ranges from 0 mm to 7 mm, the metal element improves the beam width of the antenna element in the upper hemisphere directivity pattern more obviously. However, the distance between the metal element and the antenna element in the antenna device provided in this embodiment of the present invention may be not limited to the foregoing distance range. For example, the distance between the metal element and the antenna element may be equal to 8 mm, or equal to 12 mm. In these cases, the beam width of the antenna element in the upper hemisphere directivity pattern can be improved as long as there is a distance between the metal element and the antenna element in this embodiment of the present invention. An example in which the antenna element is specifically a GPS antenna is used in the following for description. In a frequency band corresponding to the GPS antenna, λ=190 mm. As shown in FIG. 5-*c*, FIG. 5-*c* is a schematic gain curve diagram in which a gain of an antenna element varies with a distance between a metal element and the antenna element according to an embodiment of the present invention. In FIG. 5-*c*, an antenna gain curve is obtained by adjusting the distance between the metal element and the antenna element for a plurality of times when a width of the metal element is 40 mm and a length of the metal element is 47 mm. For example, NG indicates that the length is 0 (indicating no metal element), and 5 mm is an optional distance between the metal element and the antenna element in this embodiment of the present invention. It can be learned from an emulation result that an antenna gain constantly increases as the distance decreases, and the antenna gain increases more obviously when the distance is less than or equal to 7 mm and decreases.

In some embodiments of the present invention, a distance between vertical center lines respectively corresponding to the metal element and the antenna element in a length direction is greater than or equal to 0, and less than or equal to 20 mm. It should be noted that, when the distance between the vertical center lines respectively corresponding to the metal element and the antenna element in the length direction ranges from 0 mm to 20 mm, the metal element improves the beam width of the antenna element in the upper hemisphere directivity pattern more obviously. However, in the antenna device provided in this embodiment of the present invention, the distance between the vertical center lines respectively corresponding to the metal element and the antenna element in the length direction may be not limited to the foregoing distance range. For example, the distance between the vertical center lines respectively corresponding to the metal element and the antenna element in the length direction may be equal to 22 mm, or equal to 25 mm. In these cases, the beam width of the antenna element in the upper hemisphere directivity pattern can be improved as long as there is a preset distance between the metal element and the antenna element in this embodiment of the present invention. An example in which the antenna element is specifically a GPS antenna is used in the following for description. In a frequency band corresponding to the GPS antenna, λ=190 mm. As shown in the following FIG. 5-*d* and FIG. 5-*e*, an antenna gain curve is obtained by adjusting the distance between the vertical center lines respectively corresponding to the metal element and the antenna element in the length direction for a plurality of times when a width of the metal element is 40 mm, a length of the metal element is 47 mm, and a distance between the metal element and the antenna element is 5 mm. As shown in FIG. 5-*d*, FIG. 5-*d* is a schematic gain curve diagram in which a gain of an antenna element varies with a left shift of a distance between vertical center lines respectively corresponding to a metal element and the antenna element in a length direction according to an embodiment of the present invention. When relative locations of the metal element and the antenna element shift leftwards, 0 mm in FIG. 5-*d* indicates an initial location at which the metal element is aligned with the antenna element. It can be learned from an emulation result that an antenna gain slightly decreases as the metal element shifts leftwards, but an amplitude is relatively small. As shown in FIG. 5-*e*, FIG. 5-*e* is a left shifting location relationship diagram of a distance between vertical center lines respectively corresponding to a metal element and an antenna element in a length direction according to an embodiment of the present invention, where A1 indicates a vertical center line of the antenna element in a length direction, A2 indicates a vertical center line of the metal element in a length direction, and a distance between A1 and A2 is indicated by W. In this case, when W=0 mm, it indicates that the metal element is aligned with the antenna element. The metal element may shift leftwards relative to the antenna element, and therefore a value of W constantly increases.

As shown in FIG. 5-*f*, FIG. 5-*f* is a schematic gain curve diagram in which a gain of an antenna element varies with a right shift of a distance between vertical center lines respectively corresponding to a metal element and the antenna element in a length direction according to an embodiment of the present invention. When relative locations of the metal element and the antenna element shift rightwards, 0 mm in FIG. 5-*f* indicates an initial location at which the metal element is aligned with the antenna element. It can be learned from an emulation result that an antenna gain slightly decreases as the metal element shifts rightwards, but an amplitude is relatively small.

In some embodiments of the present invention, a difference between heights of the metal element and the antenna element that are relative to a plane on which the substrate is located is greater than or equal to 0, and less than or equal to 5 mm. It should be noted that, when the difference between the heights of the metal element and the antenna element that are relative to the plane on which the substrate is located ranges from 0 mm to 5 mm, the metal element improves the beam width of the antenna element in the upper hemisphere directivity pattern more obviously. However, in the antenna device provided in this embodiment of the present invention, the difference between the heights of the metal element and the antenna element that are relative to the plane on which the substrate is located may be not limited to the foregoing height range. For example, the difference between the heights of the metal element and the antenna element that are relative to the plane on which the substrate is located may be equal to 6 mm, or equal to 8 mm. In these cases, it only needs to be ensured that there is a distance between the metal element and the antenna element in this embodiment of the present invention, so that the beam width of the antenna element in the upper hemisphere directivity pattern can be improved.

An example in which the antenna element is specifically a GPS antenna is used in the following for description. In a frequency band corresponding to the GPS antenna, λ=190 mm. As shown in FIG. 6-*a*, FIG. 6-*a* is another schematic gain curve diagram in which a gain of an antenna element varies with a length (referring to FIG. 1, indicated by "L") of a metal element according to an embodiment of the present invention, where NG indicates that the length is 0 (indicating no metal element). In FIG. 6-*a*, an antenna gain curve is obtained by adjusting the length of the metal element for a plurality of times when a width of the metal element is 30 mm and a distance between the metal element and the antenna element is 5 mm. For example, 30 mm is an optional length of the metal element in this embodiment of the present invention. It can be learned from an emulation result that an antenna gain constantly increases as the length of the metal element increases, but the antenna gain starts to decrease when the length reaches 75 mm. Therefore, to achieve an optimal effect, the length of the metal element may be greater than or equal to 0.25λ, and less than or equal to 0.5λ.

As shown in FIG. 6-*b*, FIG. 6-*b* is another schematic gain curve diagram in which a gain of an antenna element varies with a width (referring to FIG. 1, indicated by "B") of a metal element according to an embodiment of the present invention. In FIG. 6-*b*, an antenna gain curve is obtained by adjusting the width of the metal element for a plurality of times when a length of the metal element is 30 mm and a distance between the metal element and the antenna element is 5 mm. For example, NG indicates that the length is 0 (indicating no metal element), and 30 mm is an optional width of the metal element in this embodiment of the present invention. It can be learned from an emulation result that an antenna gain constantly increases as the width increases, but the antenna gain starts to decrease when the width reaches 65 mm.

As shown in FIG. 6-*c*, FIG. 6-*c* is another schematic gain curve diagram in which a gain of an antenna element varies with a distance (referring to FIG. 1, indicated by "H") between a metal element and the antenna element according to an embodiment of the present invention. In FIG. 6-*c*, an antenna gain curve is obtained by adjusting the distance between the metal element and the antenna element for a plurality of times when a width of the metal element is 30 mm and a length of the metal element is 30 mm. For example, NG indicates that the length is 0 (indicating no metal element), and 5 mm is an optional distance between the metal element and the antenna element in this embodiment of the present invention. It can be learned from an emulation result that an antenna gain constantly increases as the distance decreases, and the antenna gain increases more obviously when the distance is less than or equal to 7 mm and decreases. However, compared with a size 47×40 mm of the metal element, increasing of the antenna gain is less affected by the distance.

As shown in FIG. 7-*a*, FIG. 7-*a* is another schematic gain curve diagram in which a gain of an antenna element varies with a length (referring to FIG. 1, indicated by "L") of a metal element according to an embodiment of the present invention, where NG indicates that the length is 0 (indicating no metal element). In FIG. 7-*a*, an antenna gain curve is obtained by adjusting the length of the metal element for a plurality of times when a width of the metal element is 50 mm and a distance between the metal element and the antenna element is 5 mm. For example, 60 mm is an optional length of the metal element in this embodiment of the present invention. It can be learned from an emulation result that an antenna gain constantly increases as the length of the metal element increases, but the antenna gain starts to decrease when the length reaches 75 mm. Therefore, to achieve an optimal effect, the length of the metal element may be greater than or equal to 0.25λ, and less than or equal to 0.5λ.

As shown in FIG. 7-*b*, FIG. 7-*b* is another schematic gain curve diagram in which a gain of an antenna element varies with a width (referring to FIG. 1, indicated by "B") of a metal element according to an embodiment of the present invention. In FIG. 7-*b*, an antenna gain curve is obtained by adjusting the width of the metal element for a plurality of times when a length of the metal element is 60 mm and a distance between the metal element and the antenna element is 5 mm. For example, NG indicates that the length is 0 (indicating no metal element), and 50 mm is an optional width of the metal element in this embodiment of the present invention. It can be learned from an emulation result that an antenna gain constantly increases as the width increases, but the antenna gain starts to decrease when the width reaches 65 mm.

As shown in FIG. 7-*c*, FIG. 7-*c* is another schematic gain curve diagram in which a gain of an antenna element varies with a distance (referring to FIG. 1, indicated by "H") between a metal element and the antenna element according to an embodiment of the present invention. In FIG. 7-*c*, an antenna gain curve is obtained by adjusting the distance between the metal element and the antenna element for a plurality of times when a width of the metal element is 50 mm and a length of the metal element is 60 mm. For example, NG indicates that the length is 0 (indicating no metal element), and 5 mm is an optional distance between the metal element and the antenna element in this embodiment of the present invention. It can be learned from an emulation result that an antenna gain constantly increases as the distance decreases, and the antenna gain increases more obviously when the distance is less than or equal to 7 mm and decreases.

In the foregoing application scenario of the present invention, different size specifications of the metal element and the distance between the metal element and the antenna element are described in detail in various application scenarios. It can be understood that an antenna gain effect is described by using an example in a specific application scenario in the foregoing embodiment. An antenna gain change curve needs to be emulated in a specific application scenario in a case of another size specification of the metal element and the distance between the metal element and the antenna element.

It should be noted that sizes and locations of the metal element and the antenna element, and a relative relationship between the metal element and the antenna element are further described by using an example in the foregoing embodiment. This imposes no limitation. In this embodiment of the present invention, the metal element and the antenna element need to be disposed in the antenna device according to a specific application scenario. For example, the length and the width of the metal element, the distance between the metal element and the antenna element, and the like need to be flexibly set according to an overall size of the antenna device.

In some embodiments of the present invention, a ground point of the metal element is fastened on a pad of the substrate, and the ground point is on a side of the metal element close to the antenna element. Specifically, the ground point of the metal element needs to be on the side close to the antenna element, and the metal element includes the ground point connected to the pad of the substrate, that is, the metal element includes a cable connected to the substrate for grounding. A first reverse current generated by the metal element when the ground point of the metal element is on the side of the metal element close to the antenna element is greater than a first reverse current generated by the metal element when the ground point of the metal element is on a side of the metal element far away from the antenna element.

In some embodiments of the present invention, the metal element may be specifically a battery component disposed on the substrate. That is, in this embodiment of the present invention, the metal element may be implemented by using a battery metal enclosure in the battery component, so as to complete a function of the metal element in this embodiment of the present invention by using an existing battery component in the antenna device instead of adding an additional component. This imposes no limitation. In this embodiment of the present invention, the metal element may be not limited to the foregoing battery component, and the metal element may also be implemented by using another existing metal piece that can implement coupling induction in the antenna device. In the antenna device provided in this embodiment of the present invention, an antenna upper hemisphere beam width and an antenna gain can be effectively improved by directly using the metal element, and antenna receiving performance can be effectively enhanced without adding an additional component.

In some embodiments of the present invention, the substrate may be specifically a printed circuit board (Printed Circuit Board, PCB). This imposes no limitation. The substrate in this embodiment of the present invention is an electronic component, and any electronic component that can implement a support function and an electrical connection function may be used as the substrate in the antenna device provided in this embodiment of the present invention.

It should be noted that for the foregoing apparatus embodiments, for brief description, the foregoing apparatus embodiments are represented as a series of components. However, persons skilled in the art should understand that the present invention is not limited to the described composition order. In addition, persons skilled in the art should also understand that the embodiments described herein are preferred embodiments, and the actions and modules mentioned are not necessarily required by the present invention.

To better implement the foregoing solution in this embodiment of the present invention, a related method used to implement the foregoing solution is provided in the following. In a beam direction adjustment method applied to an antenna device, the antenna device includes an antenna element, a metal element, and a substrate. The method includes the following steps:

separately disposing the antenna element and the metal element on the substrate, where the metal element is separated from the antenna element on the substrate by a preset distance; obtaining, through coupling on a side of the metal element close to the antenna element, a first reverse current opposite to an antenna current generated by the antenna element; and obtaining, through coupling at a lower part of the metal element that is in contact with the substrate, a second reverse current opposite to a substrate current generated by the substrate, so that a beam width of the antenna element in an upper hemisphere directivity pattern is increased by combining the first reverse current and the antenna current and combination of the second reverse current and the substrate current.

In some embodiments of the present invention, the foregoing method further includes: adjusting a length of the metal element to be greater than or equal to 0.25λ, and less than or equal to 0.5λ, where λ is a wavelength corresponding to the first frequency.

In some embodiments of the present invention, the foregoing method further includes: adjusting a width of the metal element to be greater than or equal to 0.25λ, and less than or equal to 0.5λ, where λ is a wavelength corresponding to the first frequency.

In some embodiments of the present invention, the foregoing method further includes: adjusting the distance between the metal element and the antenna element on the substrate to be less than or equal to 7 mm.

In some embodiments of the present invention, the foregoing method further includes: adjusting a distance between vertical center lines respectively corresponding to the metal element and the antenna element in a length direction to be greater than or equal to 0, and less than or equal to 20 mm.

In some embodiments of the present invention, the foregoing method further includes: adjusting a difference between heights of the metal element and the antenna element that are relative to a plane on which the substrate is located to be greater than or equal to 0, and less than or equal to 5 mm.

It should be noted that content such as an execution process of each step in the foregoing method is based on the same idea as the apparatus embodiments of the present invention, and produces the same technical effects as the apparatus embodiments of the present invention. For the specific content, refer to the descriptions in the apparatus embodiments of the present invention, and details are not described herein again.

It can be learned from the foregoing illustration of the embodiment of the present invention that the antenna device includes the antenna element, the metal element, and the substrate. The antenna element and the metal element are separately disposed on the substrate, and there is the preset distance between the metal element and the antenna element on the substrate. The antenna element works at least at the first frequency. In the antenna device provided in this embodiment of the present invention, the metal element is disposed on the substrate, the ground point of the metal element is fastened on the pad of the substrate, and the ground point is on the side of the metal element close to the antenna element. The metal element and the antenna element are separated from each other on the substrate. In addition, the metal element can obtain, through coupling, the first reverse current opposite to the antenna current generated by the antenna element, and can also obtain, through coupling on the metal element, the second reverse current opposite to the substrate current generated by the substrate. The first reverse current and the second reverse current generated by the metal element are respectively combined with the antenna current and the substrate current, so as to reduce a beam width of the antenna element in a direction other than the upper hemisphere directivity pattern. Therefore, the beam width of the antenna element in the upper hemisphere directivity pattern is effectively extended, and the upper hemisphere directivity pattern of the antenna can be effectively improved. In this embodiment of the present invention, only a metal element needs to be deployed in the antenna device, and various complex feeding systems are not required, so that a volume of the antenna device is not increased.

In addition, it should be noted that the described apparatus embodiment is merely an example. The units described as separate parts may or may not be physically separate, and parts displayed as units may or may not be physical units, may be located in one position, or may be distributed on a plurality of network units. Some or all the modules may be selected according to actual needs to achieve the objectives of the solutions of the embodiments. In addition, in the accompanying drawings of the apparatus embodiments provided by the present invention, connection relationships between modules indicate that the modules have communication connections with each other, which may be specifically implemented as one or more communications buses or signal cables. Persons of ordinary skill in the art may understand and implement the embodiments of the present invention without creative efforts.

Based on the description of the foregoing implementations, persons skilled in the art may clearly understand that the present invention may be implemented by software in addition to necessary universal hardware, or by dedicated hardware, including a dedicated integrated circuit, a dedicated CPU, a dedicated memory, a dedicated component, and the like. Generally, any functions that can be performed by a computer program can be easily implemented by using corresponding hardware. Moreover, a specific hardware structure used to achieve a same function may be of various forms, for example, in a form of an analog circuit, a digital circuit, a dedicated circuit, or the like. However, as for the present invention, software program implementation is a better implementation in most cases.

The foregoing embodiments are merely intended for describing the technical solutions of the present invention, but not for limiting the present invention. Although the present invention is described in detail with reference to the foregoing embodiments, persons of ordinary skill in the art should understand that they may still make modifications to the technical solutions described in the foregoing embodiments or make equivalent replacements to some technical features thereof, without departing from the spirit and scope of the technical solutions of the embodiments of the present invention.

What is claimed is:

1. An antenna device, comprising:

an antenna element;

a metal element; and a substrate;

wherein the antenna element and the metal element are separately disposed on the substrate, and there is a preset distance between the metal element and the antenna element on the substrate;

wherein the antenna element works at a first frequency, a ground point of the metal element is fastened on a pad of the substrate, and the ground point is on a side of the metal element that faces the antenna element; and wherein an antenna current is generated by the antenna element;

wherein a first reverse current is opposite to the antenna current, and the first reverse current is obtained by a coupling between the side of the metal element that faces the antenna element and the antenna element;

wherein a substrate current is generated by the substrate; and wherein a second reverse current is opposite to the substrate current, and the second reverse current is obtained by a coupling between a lower part of the metal element that is in contact with the substrate and the substrate.

2. The antenna device according to claim 1, wherein a length of the metal element is greater than or equal to 0.25λ and less than or equal to 0.5λ, and wherein λ is a wavelength corresponding to the first frequency.

3. The antenna device according to claim 1, wherein a width of the metal element is greater than or equal to 0.25λ and less than or equal to 0.5λ, and wherein λ is a wavelength corresponding to the first frequency.

4. The antenna device according to claim 1, wherein the preset distance between the metal element and the antenna element on the substrate is less than or equal to 7 mm.

5. The antenna device according to claim 1, wherein vertical center lines respectively correspond to the metal element and the antenna element, and a distance between the vertical lines in a length direction is greater than or equal to 0 mm and less than or equal to 20 mm.

6. The antenna device according to claim 1, wherein a difference between heights of the metal element and the antenna element that are relative to a plane on which the substrate is located is greater than or equal to 0 mm and less than or equal to 5 mm.

7. The antenna device according to claim 1, wherein the metal element is a battery component disposed on the substrate.

8. The antenna device according to claim 1, wherein the substrate is a printed circuit board (PCB).

9. The antenna device according to claim 1, wherein the antenna element is a global positioning system (GPS) antenna.

10. A method, comprising:

separately disposing an antenna element and a metal element on a substrate of an antenna device, wherein the metal element is separated from the antenna element on the substrate by a preset distance, and wherein the antenna device comprises the antenna element, the metal element, and the substrate, the antenna element works at a first frequency, a ground point of the metal element is fastened on a pad of the substrate, and the ground point is on a side of the metal element faces the antenna element;

obtaining, by a coupling between the side of the metal element that faces the antenna element and the antenna element, a first reverse current, wherein the first reverse current is opposite to an antenna current, and the antenna current is generated by the antenna element; and obtaining, by a coupling between a lower part of the metal element that is in contact with the substrate and the substrate, a second reverse current, wherein the second reverse current is opposite to a substrate current generated by the substrate, and wherein a beam width of the antenna element in an upper hemisphere directivity pattern is increased by combining the first reverse current and the antenna current and by combining the second reverse current and the substrate current.

11. The method according to claim 10, wherein a length of the metal element is greater than or equal to 0.25λ and less than or equal to 0.5λ, and wherein λ is a wavelength corresponding to the first frequency.

12. The method according to claim 10, wherein a width of the metal element is greater than or equal to 0.25λ and less than or equal to 0.5λ, and wherein λ is a wavelength corresponding to the first frequency.

13. The method according to claim 10, wherein the preset distance between the metal element and the antenna element on the substrate to be less than or equal to 7 mm.

14. The method according to claim 10, wherein vertical center lines respectively correspond to the metal element and the antenna element, and a distance between the vertical center lines in a length direction is greater than or equal to 0 and less than or equal to 20 mm.

15. The method according to claim 10, wherein a difference between heights of the metal element and the antenna element that are relative to a plane on which the substrate is located is greater than or equal to 0 and less than or equal to 5 mm.

16. A method, comprising:

increasing, by an antenna device, a beam width of an antenna element in an upper hemisphere directivity pattern by combining a first reverse current and an antenna current, and by combining a second reverse current and a substrate current, wherein:

the antenna element and a metal element are separately disposed on a substrate of the antenna device, and there is a preset distance between the metal element and the antenna element on the substrate;

the antenna element works at a first frequency, a ground point of the metal element is fastened on a pad of the substrate, and the ground point is on a side of the metal element that faces the antenna element;

the antenna current is generated by the antenna element;

the first reverse current is opposite to the antenna current, and the first reverse current is obtained by a coupling between the side of the metal element that faces the antenna element and the antenna element;

the substrate current is generated by the substrate; and the second reverse current is opposite to the substrate current, and the second reverse current is obtained by a coupling between a lower part of the metal element that is in contact with the substrate and the substrate.

17. The method according to claim 16, wherein a length of the metal element is greater than or equal to 0.25λ and less than or equal to 0.5λ, and wherein λ is a wavelength corresponding to the first frequency.

18. The method according to claim 16, wherein a width of the metal element is greater than or equal to 0.25λ and less than or equal to 0.5λ, and wherein λ is a wavelength corresponding to the first frequency.

19. The method according to claim 16, wherein the preset distance between the metal element and the antenna element on the substrate is less than or equal to 7 mm.

20. The method according to claim 16, wherein vertical center lines respectively correspond to the metal element and the antenna element, and a distance between the vertical lines in a length direction is greater than or equal to 0 mm and less than or equal to 20 mm.

* * * * *